US005535285A

United States Patent [19]

Jwo

[11] Patent Number: 5,535,285

[45] Date of Patent: Jul. 9, 1996

[54] FIXATION OF SPEAKER TO A MONITOR

[75] Inventor: Chun J. Jwo, Taoyuan, Taiwan

[73] Assignee: Acer Peripherals, Inc., Taoyuan, Taiwan

[21] Appl. No.: 516,821

[22] Filed: Aug. 18, 1995

[51] Int. Cl.[6] ..... H04R 25/00

[52] U.S. Cl. ..... 381/188; 381/205

[58] Field of Search ..... 381/24, 86, 188, 381/205, 150, 152; 361/683, 686; 455/347, 350

[56] References Cited

U.S. PATENT DOCUMENTS

| | | | |
|---|---|---|---|
| 4,672,675 | 6/1987 | Powell et al. | 381/188 |
| 4,727,587 | 2/1988 | Black | 381/205 |

*Primary Examiner*—Curtis Kuntz
*Assistant Examiner*—Huyen D. Ie
*Attorney, Agent, or Firm*—Fish & Richardson

[57] ABSTRACT

The speaker comprises a speaker housing, a speaker body and a second connector device. The speaker housing has two internal bosses extending from the inside surface of the housing and corresponding to two holes of the intermediate frame. The intermediate frame forms a part of the monitor casing, and the edges thereof are adjacent to the side edge of the bezel for cathode ray tube (CRT) within the monitor and the side edge of the main casing of the monitor respectively. The internal boss has entire-depth bore for receiving the second connector device. The speaker body is received in the speaker housing. The speaker body is adapted to connect to a first and a second signal terminals, each of the signal terminals having a hole thereon which corresponds and aligns to the entire-depth hole and one of the holes of the intermediate frame. The second connector device passes through the entire-depth hole of the boss and the hole of the signal terminal and connects to the first connector device for connecting the speaker to the intermediate frame and for connecting one of polarities of the audio input to one of the signal terminals. The first connector device is coupled to one of a positive and a negative polarity of an audio input.

3 Claims, 3 Drawing Sheets

FIXATION OF SPEAKER TO A MONITOR

TECHNICAL FIELD OF INVENTION

The present invention relates to a speaker which is connected to a monitor via a connector device and receives the audio input via the connector device.

BACKGROUND OF INVENTION

Multi-medium computer system has been forecast as a trend in the market. The speaker, as a component of multi-medium computer system, in general, needs an external wires to receive the audio output from the sound generation interface card within the computer system.

The external wirings approach adopted by state-of-art multi-medium computer system makes the desktop disordered.

SUMMARY OF INVENTION

In order to provide a well-organized multi-medium computer system, the speaker of the invention is adapted to connect to a monitor via a connector device and receives the audio input via the connector device.

The monitor device has an intermediate frame with two holes, each of the two holes allowing passage of a first connector device. The first connector device is coupled to one of a positive and a negative polarity of an audio input.

The speaker comprises a speaker housing, a speaker body and a second connector device.

The speaker housing has two internal bosses extending from the inside surface of the housing and corresponding to two holes of the intermediate frame. The internal boss has entire-depth bore for receiving the second connector device.

The speaker body is received in the speaker housing. The speaker body is adapted to connect to a first and a second signal terminals, each of the signal terminals having a hole thereon which corresponds and aligns to the entire-depth hole and one of the holes of the intermediate frame.

The second connector device passes through the entire-depth hole of the boss and the hole of the signal terminal and connects to the first connector device for connecting the speaker to the intermediate frame and for connecting one of polarities of the audio input to the signal terminal.

In a preferred embodiment, the first connector device is a internally threaded metal sleeve. The metal may be a copper.

In a preferred embodiment, the second connector device is a male screw ringed with a metal sleeve. When the speaker is connected to the intermediate frame, the metal sleeve of the second connector device comes in contact with the metal sleeve of the first connector device.

BRIEF DESCRIPTION OF THE APPENDED DRAWINGS

DETAILED DESCRIPTIONS OF THE PREFERRED EMBODIMENT

Figure 1:
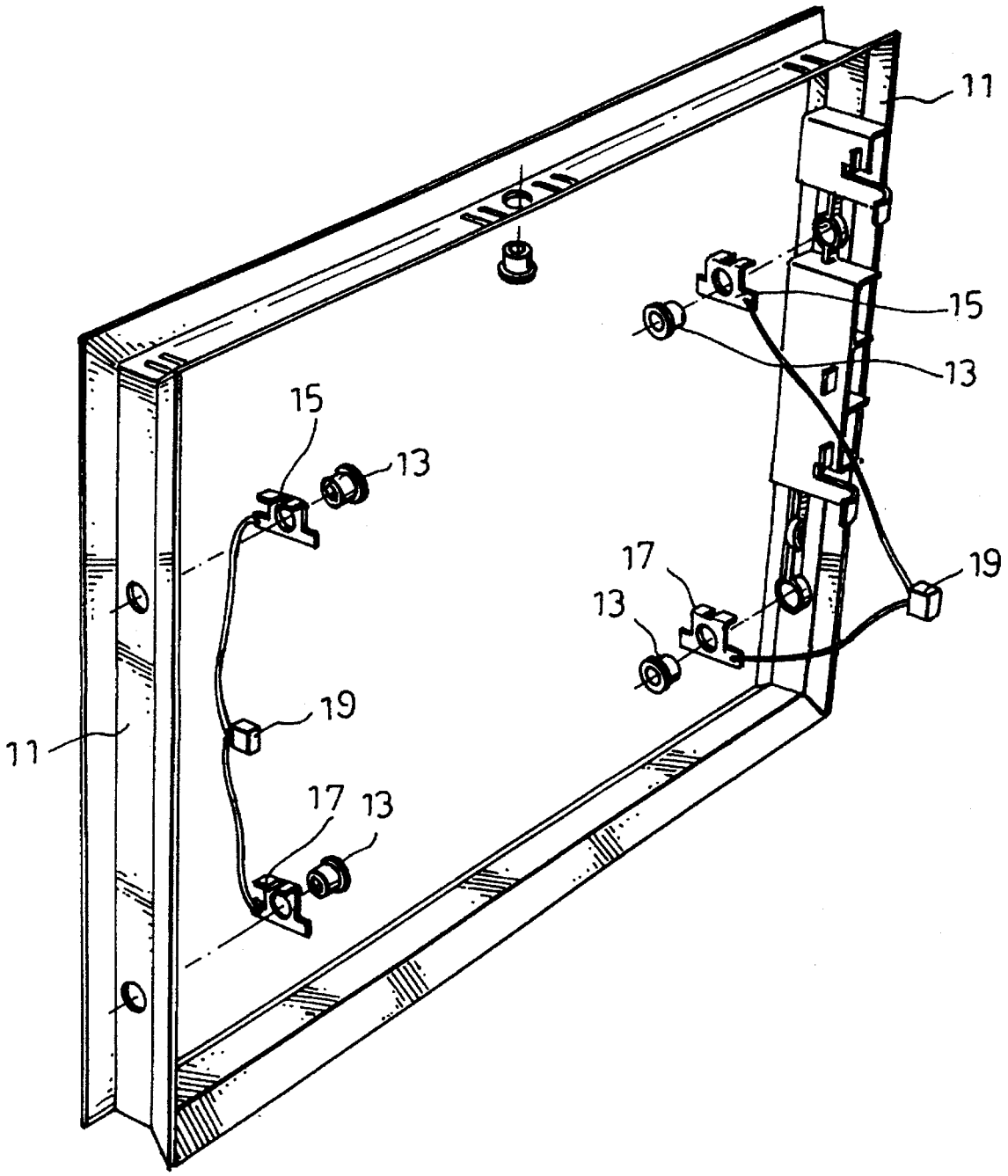
FIG. 1 shows the perspective view of the intermediate frame of the monitor.

As shown in FIG. 1, to provide a connection between the monitor and the speaker, the monitor device has a intermediate frame 11 with two holes. The intermediate frame 11 forms a part of the monitor casing, and the edges thereof are adjacent to the side edge of the bezel for cathode ray tube (CRT) within the monitor and the side edge of the main casing of the monitor respectively as well known in the arts. Each of two holes allows passage of a first connector device 13 which is coupled to one of positive 15 and negative 17 polarities of an audio input coming from socket 19.

Figure 2:
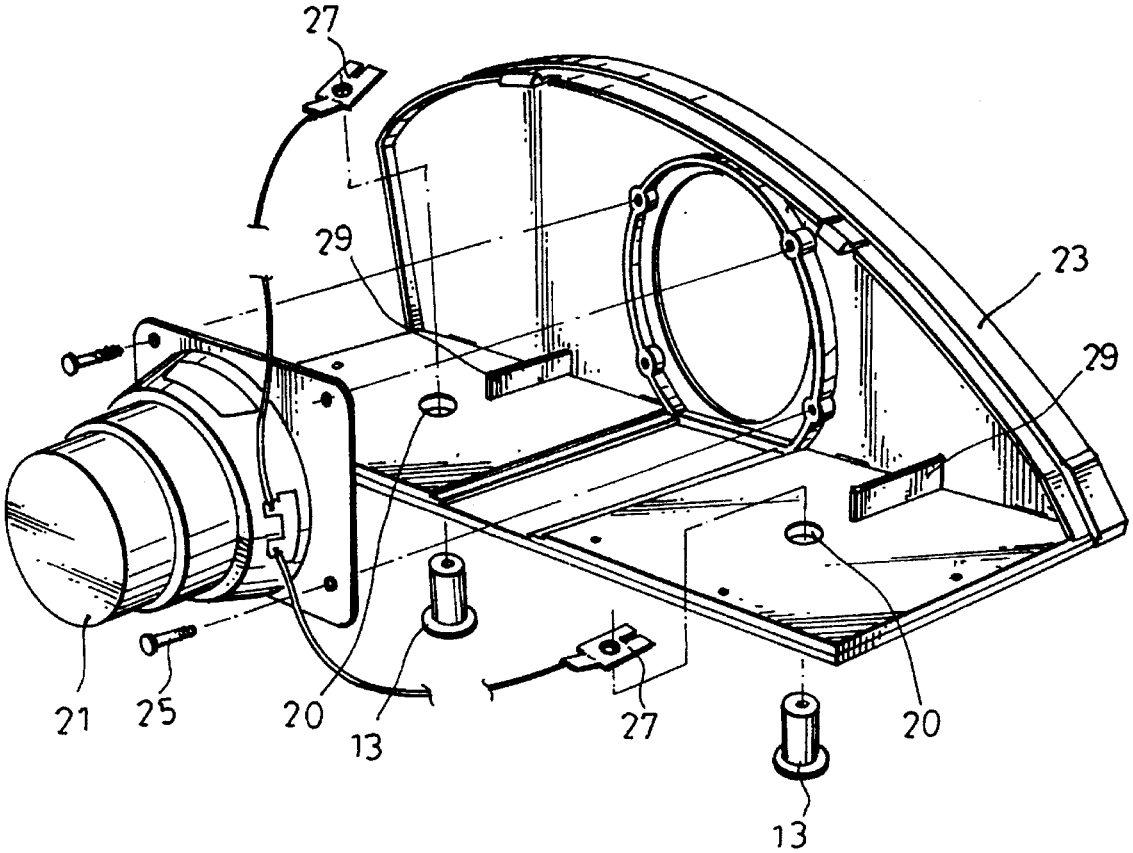
FIG. 2 shows the explosive view of the speaker front panel and speaker body.
Figure 3:
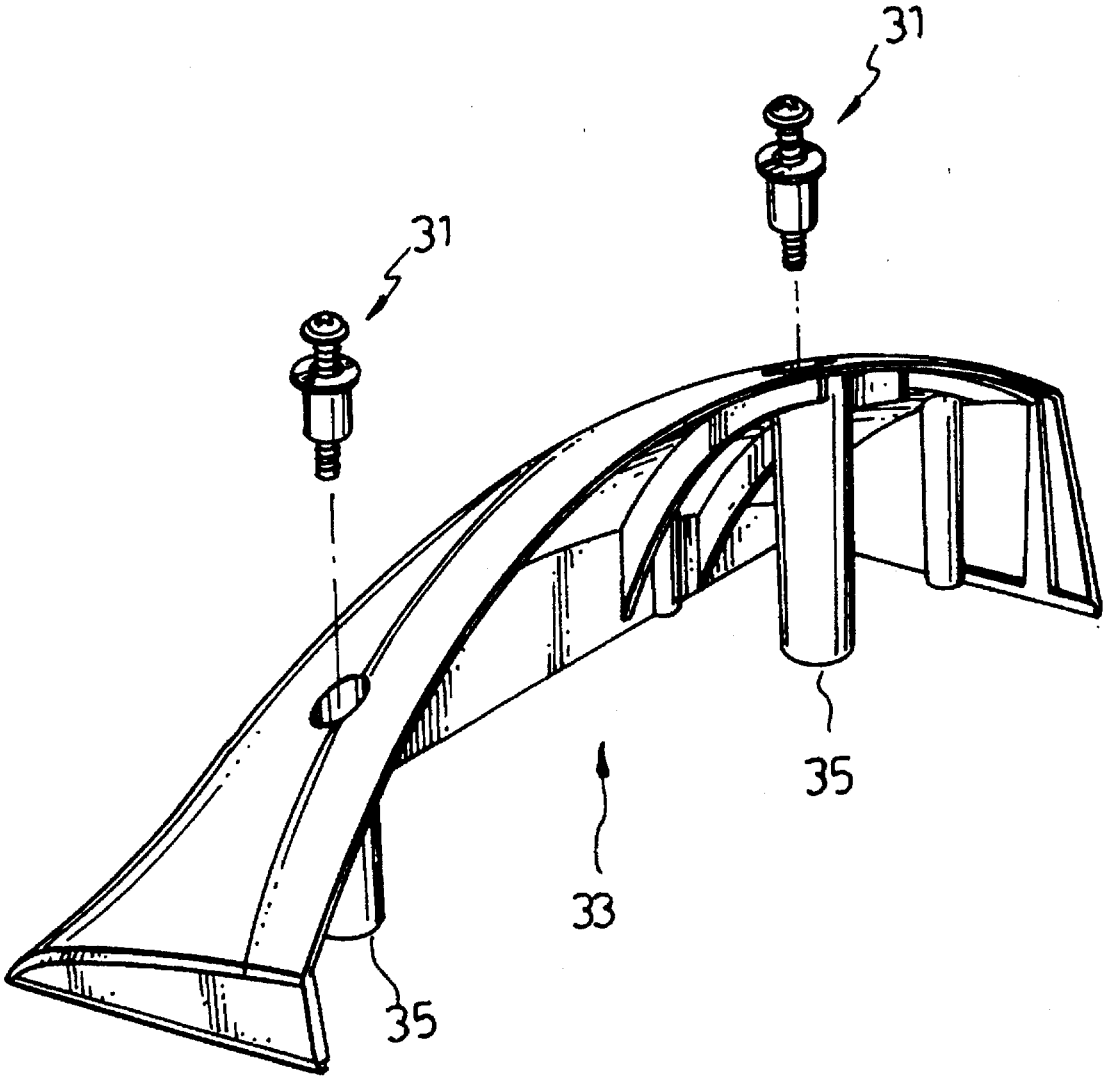
FIG. 3 shows the explosive view of the speaker side shell and the associated connector device.

As shown in FIG. 2 and 3, the speaker comprises a speaker housing, a speaker body 21 and a second connector device 31. The speaker housing includes a front panel 23, a side shell 33. In addition, the side shell 33 has two bosses 35 extending from the inside surface of the shell and corresponding to two holes of the intermediate frame 11. The internal boss 35 has entire-depth bore for receiving the second connector device 31. The front panel 23 has two projections 29 extending from the inside surface of the panel and corresponding apertures 20.

The speaker body 21 is received in and attached to the speaker housing via four screws 25. The speaker body 21 is adapted to connect to a first and a second signal terminals 27. In assembly state, the slot of the terminal 27 is engaged with the projection 29 extending from inside surface of the front panel 23. Each of the terminals 27 has a hole thereon which, when in assembly state, corresponds and aligns to the aperture 20, the entire-depth bore of the boss 35, and corresponds to one of two holes of the intermediate frame 11.

It is obvious from FIG. 3 and 2, that, to assemble the speaker to the intermediate frame 11, the second connector device 31 is received in the bore of boss 35 and the end of the second connector device 31 passes through first and second open-ends of the boss 35, the hole on the signal terminal 27, the corresponding aperture 20 on the front panel 23, and, thereafter, connects with the first connector device 13 within the monitor.

Therefore, the end of the second connector device 31, passing through the entire-depth bore of the boss 35, the hole of the signal terminal 27 and the aperture 20 of the front panel 23, connects with the first connector device 31 such that the speaker is connected to the intermediate frame 11 of the monitor. At the same time, the connection connects one of polarities of the audio input, via the signal terminal 27, to the speaker body 21.

Among other choices, the first connector device 13 is a internally threaded metal sleeve.

Among other choice, the second connector device 31 is a male screw ringed with a shorter metal sleeve.

When the speaker is connected to the intermediate frame 11, the metal sleeve of the second connector device 31 comes in contact with the metal sleeve of the first connector device 13 thereby forming a path of the audio signal.

I claim:

1. A speaker connectable to a monitor device, the monitor device having an intermediate frame with two holes, each of said two holes allowing passage of a first connector means, the first connector means being coupled to one of positive and negative polarities of an audio input, the speaker comprising:

a speaker housing having two bosses extending from an inside surface of the housing and two corresponding apertures, the boss having an entire-depth hole corresponding to one of two holes of the intermediate frame and one of the two apertures;

a speaker body received in the speaker housing, the speaker body being connected to a first and a second signal terminals, each of the signal terminals having a hole thereon which corresponds and aligns to the entire-depth hole of the boss and one of the two apertures;

a second connector means, received in the entire-depth hole of the boss, for connecting with the first connector device such that the speaker is connected to the intermediate frame and for connecting said one of polarities of the audio input to one of the signal terminals.

2. The speaker as recited in claim 1, wherein the first connector means is an internally threaded metal sleeve.

3. The speaker as recited in claim 2, wherein the second connector means is a male screw ringed with a shorter metal sleeve, and, when the speaker is connected to the intermediate frame, the metal sleeve of the second connector device comes in contact with the metal sleeve of the first connector device thereby forming a path of audio input.

* * * * *